US007887680B2

(12) United States Patent
Delcorde

(10) Patent No.: US 7,887,680 B2
(45) Date of Patent: Feb. 15, 2011

(54) DEVICE AND METHOD FOR MAINTAINING AND CONNECTING AN ANODE ROD ON AN ANODE FRAME OF AN ALUMINUM ELECTROLYTIC CELL

(75) Inventor: Xavier Delcorde, Villeneuve d'Ascq (FR)

(73) Assignee: E. C. L., Ronchin (FR)

( * ) Notice: Subject to any disclaimer, the term of this patent is extended or adjusted under 35 U.S.C. 154(b) by 663 days.

(21) Appl. No.: 11/911,746

(22) PCT Filed: Apr. 18, 2006

(86) PCT No.: PCT/FR2006/000844

§ 371 (c)(1),
(2), (4) Date: Nov. 26, 2007

(87) PCT Pub. No.: WO2006/111649

PCT Pub. Date: Oct. 26, 2006

(65) Prior Publication Data

US 2008/0142357 A1 Jun. 19, 2008

(30) Foreign Application Priority Data

Apr. 20, 2005 (FR) ..... 05 03944

(51) Int. Cl.
*C25B 9/02* (2006.01)

(52) U.S. Cl. ..... 204/288.6; 204/288.41; 204/286.1; 204/297.01; 204/279; 204/243.1

(58) Field of Classification Search ..... 204/243.1, 204/279, 286.1, 288.4, 288.6, 297.01
See application file for complete search history.

(56) References Cited

U.S. PATENT DOCUMENTS

| | | | | |
|---|---|---|---|---|
| 3,627,670 | A * | 12/1971 | Duclaux | 204/297.14 |
| 4,269,673 | A * | 5/1981 | Clark | 205/374 |
| 4,394,242 | A | 7/1983 | Clark | |
| 5,378,338 | A * | 1/1995 | Langon et al. | 204/247.4 |
| 7,344,625 | B2 * | 3/2008 | Delescluse | 204/288.4 |
| 2004/0211663 | A1 | 10/2004 | Gagne et al. | |
| 2005/0266735 | A1 * | 12/2005 | Delescluse | 439/709 |
| 2006/0049054 | A1 * | 3/2006 | Van Acker et al. | 205/81 |
| 2006/0137972 | A1 * | 6/2006 | Van Acker et al. | 204/194 |
| 2006/0290153 | A1 * | 12/2006 | Delescluse | 294/115 |
| 2009/0238665 | A1 * | 9/2009 | Van Acker et al. | 414/226.01 |
| 2010/0116653 | A1 * | 5/2010 | Van Acker | 204/297.01 |

FOREIGN PATENT DOCUMENTS

| | | |
|---|---|---|
| EP | 0 178766 | 4/1985 |
| RU | 1 522786 | 12/1996 |
| SU | 981457 | 12/1982 |

* cited by examiner

*Primary Examiner*—Bruce F Bell
(74) *Attorney, Agent, or Firm*—Dennison, Schultz & MacDonald

(57) ABSTRACT

An anode rod is placed between two hooks fixed to an anode beam and onto which a connector bears, including two levers, two coaxial lateral rods and a screw that can pivot levers between a clamping position of the anode rod in contact with the anode beam and a release position. The geometry of at least one hook, a lever and/or a lateral rod and the material from which they are formed are such that the elastic deformation of the holding device with respect to the anode beam when the screw is tightened is sufficient. Thus, this device can compensate for a change in the position of the anode rod by elastic return towards its unstressed position, and thus continues to keep the anode rod firmly in contact with the anode beam.

25 Claims, 5 Drawing Sheets

DEVICE AND METHOD FOR MAINTAINING AND CONNECTING AN ANODE ROD ON AN ANODE FRAME OF AN ALUMINUM ELECTROLYTIC CELL

BACKGROUND OF THE INVENTION

This invention relates to a connector, a hook and a device for holding and connecting an anode rod in contact with an anode beam of an aluminium electrolytic cell, and a method for holding and connecting such an anode rod.

Aluminium metal is produced industrially by electrolysis of alumina in solution in an electrolyte bath using the Hall-Héroult process. The electrolyte bath is contained in an electrolysis pot comprising a steel shell that is coated on the inside with refractory and/or insulating materials, and at the bottom of which a cathode assembly is located. Anodes, typically made of a carbonaceous material, are partially immersed in the electrolyte bath.

Each anode is provided with a metallic rod that will be used for electrically and mechanically connecting it to an anode beam free to move with respect to a portal frame fixed above the electrolysis tank. Each anode rod is connected to the anode beam using hooks on each side of the anode rod and to a removable connector that can be placed on these hooks and that can bring the anode rod into contact with the anode beam.

Anode rods are connected to the cathode frame in different cases during the life of the installation:

- during start up of the installation, just at the beginning of steady state operation, after the preheating phase;
- during steady state operation, when the anode beam has reached the lower limit of its travel distance and it needs to be raised above the set of anodes in order to continue operation;
- when the anodes are too spent and/or deteriorated and they have to be replaced.

It can sometimes happen that the anode rods are badly positioned during this connection operation, for example they might be slightly oblique instead of being perfectly vertical. This problem arises particularly when the anodes are replaced, since in this case they can be held in this incorrect position due to the crust formed on the surface of the electrolyte bath. It is difficult to detect this bad positioning due to the apparent support provided by the crust, and the connector appears to be fulfilling its purpose perfectly well.

However, under steady state operation conditions, the crust melts and then can no longer hold the anode rod in position. The anode rod is then no longer satisfactorily held in contact with the anode beam by the connector due to the incorrect initial positioning. The result is deterioration of the electrical and mechanical connection, and this deteriorates the performances of the installation. In the worst case, the anode rod can slide with respect to the anode beam and fall into the bottom of the electrolytic pot, thus requiring long and expensive operations.

In general, this problem arises when the anode position changes for different reasons. The forces applied to the anode rod are then modified from the forces in the initial position in which the clamping of the anode rod was satisfactory. Consequently, the connector no longer satisfactorily holds the anode rod in contact with the anode beam.

Documents EP 0 178 766 and U.S. Pat. No. 5,876,585 describe temporary connection devices that clamp the anode rod in contact with the anode beam when the installation is being started up. These connection devices comprise means such as rollers and spring or Belleville washer type systems enabling relative displacement of the anode rod while maintaining satisfactory clamping at the different expansion and deformation stages of the elements in the electrolytic cell being preheated.

However, these devices are only designed for use in the preheating phase of the installation during which the anodes are put down on the bottom of the pot. During continuous operating conditions, when the anodes are no longer supported on the bottom of the pot, the rollers would not be capable of providing sufficient clamping of the anode rods. Thus, during steady state operation conditions, document U.S. Pat. No. 5,876,585 describes the use of connection devices without any compensation means such as rollers and springs.

Furthermore, these devices are not sufficient to compensate for bad initial positioning of the anode rod with respect to the anode beam, because in this case, the consequences on the displacement of the rod are much greater than the consequences of an increase in temperature of the components of the cell.

French application FR 2 039 543 describes a connector with a body comprising two levers that will apply pressure on the anode rod towards the anode beam through at least one bearing face, two substantially coaxial lateral rods each projecting beyond the sides of the said body, and each designed to rest on a hook fixed to the anode beam on each side of the rod, and a clamping screw that can make the levers pivot about the axis of the lateral rods, such that the connector can be in two particular geometric configurations; a clamping configuration in which the bearing face of the levers is in contact with the anode rode and forces it towards the anode beam substantially perpendicular to the anode beam, and a releasing (or "release") configuration in which the bearing face of the levers does not apply any pressure on the anode rod. This type of connector is currently used in electrolysis workshops both in preheating and under continuous operating conditions, but it does not have any compensation means of allowing significant relative movement of the anode rod while maintaining satisfactory clamping of the anode rod on the anode beam.

SUMMARY OF THE INVENTION

This invention is designed to overcome the disadvantages mentioned above, by providing a solution to assure excellent clamping of the anode rod in contact with the anode beam despite incorrect initial positioning, by means of one connector, a hook and/or device that can be used in the preheating phase and also under steady state operation conditions.

According to a first aspect, the invention relates to a connector for holding and connecting an anode rod in contact with an anode beam of an aluminium electrolytic cell, comprising:

- a body comprising at least one mobile part comprising a bearing face, the said mobile part moving such that the said bearing face applies pressure on the anode rod, along a direction substantially perpendicular to the contact surface of the anode beam;
- a pair of substantially axial lateral protuberances each projecting beyond the sides of the said body, oriented substantially perpendicular to the said direction and each of them being intended to rest on a hook fixed to the anode beam, on each side of the anode rod;
- and an actuator that can displace the said mobile part to bring it between a clamping position in which the said bearing face is in contact with the anode rod and forces it towards the anode beam when the said lateral protuberances rest on the said hooks, and a release position in which the said bearing face does not apply any pressure on the anode rod;

characterised in that the said connector at least partially has a geometry and/or is at least partially composed of a material such that, when the said actuator brings the mobile part into the clamping position, the said connector is elastically deformed sufficiently so that, if there is a change in the position of the anode rod with respect to the anode beam, the said connector remains in contact with the said anode rod due to its at least partial elastic return towards its unstressed position, and thus continues to hold the said anode rod firmly in contact with the said anode beam.

In other words, the connector according to the invention comprises at least one part capable of storing sufficient elastic deformation energy to cause a large displacement of the bearing face towards the anode beam, when the clamping force is released. This part that is particularly elastically deformable can be all or part of the mobile part, a connecting element between the mobile part and the actuator, or all or part of the pair of lateral protuberances. Obviously, it would also be possible to combine several of these connector parts such that the connector as a whole is capable of storing the said sufficient elastic energy.

The purpose is to store reserve mechanical energy in the connector such that if the contact stresses related to a relative displacement of the anode rod with respect to the anode beam are released, the bearing force of the connector in contact with the anode beam, due to elastic return of the said connector, can move the bearing face by a certain distance towards the said anode rod. In practice, the applicant has estimated that the said sufficient elastic deformation must result in displacement of the bearing face of the mobile part towards the anode beam by at least 0.6 millimetres, and preferably more than 1 mm, or even 2 mm, or even 3 mm, during an elastic return due to a reduction in the clamping force. Another way of estimating the said sufficient elastic deformation is to aim to achieve compensation of an angular displacement of the anode rod with respect to the vertical by at least 0.15°, and preferably at least 0.3°.

Therefore the part of the connector capable of storing a large elastic deformation must have a geometry and must be composed of a material with a sufficiently high yield stress so that such a displacement, typically more than 0.6 mm, will result in a purely elastic deformation. Preferably, a material will be chosen for which the yield stress is greater than 1000 N/mm2, and is typically a metal and particularly steel.

A preferred embodiment of a connector according to the invention comprises:

- a body comprising two levers forming the mobile parts intended for applying a pressure on the anode rod towards the anode beam through at least one bearing face;
- two substantially coaxial lateral rods as the protuberances, each projecting laterally from the said body and each of them being designed to rest on a hook fixed to the anode beam, on each side of the anode rod;
- a clamping screw as actuator, capable of making the levers pivot around the axis of the lateral rods between a clamping position in which the bearing face of the levers is in contact with the anode rod and moves it towards the anode beam substantially perpendicular to the anode beam, and a release position in which the bearing face of the levers does not apply pressure on the anode rod.

The two lateral rods can be formed from a single rod passing through the connector body. The geometry of at least one lever and/or lateral rod of the connector and the material from which it is made are capable of enabling sufficient elastic deformation of the connector when the screw is tightened for holding and connection of the anode rod, so that if the position of the anode rod with respect to the anode beam is changed, the said connector remains in contact with the said anode rod due to its at least partial elastic return towards its unstressed position, and thus continues to hold the said anode rod firmly in contact with the said anode beam. A reserve of mechanical energy is thus built up in the connector that can be automatically restored if there is a movement of the anode rod, so that the anode rod is always satisfactorily connected with and held in contact with the anode beam.

For example, the connector has a sufficiently long lateral rod so that the distance between the body of the connector and the bearing area of this rod that will bear on the hook fixed to the anode beam will be supported is sufficiently large to enable elastic deformation of the said rod and consequently a displacement of the connector body and consequently also its bearing face on the anode rod, substantially perpendicular to the anode beam, with an amplitude greater than 0.6 mm. Preferably, at least one lateral rod is made from a material for which the yield stress is more than 1000 N/m2, and typically a metal and particularly steel.

The said distance between the body of the connector and the bearing area of this lateral rod may be more than 50 mm or even 90 mm, and the displacement amplitude of the connector body may exceed 1 mm, or even 2 mm or even 3 mm. The distance between the body of the connector and the bearing area of the corresponding lateral rod may be between 20 and 40% of the distance between the bearing areas of the two lateral rods (in other words the distance between the two hooks fixed to the anode beam).

At least one lever may comprise at least one end plate with a recess formed from its upper or lower edge and defining two branches separated from each other in a direction perpendicular to the lateral rods. The bottom of the recess can then form a housing in which a lateral rod will fit.

At least one lever may be fitted with an elastic pad, at least part of which forms the bearing face for the said lever on the anode rod. This pad may be in the form of an elastic tab folded on itself, and preferably made from metal, and particularly steel.

According to another aspect, the invention relates to a hook designed to be fixed to the anode beam of an aluminium electrolytic cell to hold and connect an anode rod placed on the side of the hook in contact with the anode beam, and on which a connector will rest that can be actuated between a clamping position in which the connector is in contact with the anode rod and pulls it towards the anode beam substantially perpendicular to the anode beam, and a release position in which the connector does not apply any pressure on the anode rod. The geometry of the hook and the material from which it is made are such that, when the connector is moved towards the clamping position, they enable a sufficient elastic deformation of the hook with respect to the anode beam so that the hook can compensate for a possible change in the position of the anode rod with respect to the anode beam, the said connector remains in contact with the said anode rod due to its at least partial elastic return towards its unstressed position, and thus continues to hold the said anode rod firmly in contact with the said anode beam. In other words, a reserve of mechanical energy is formed in the hook or each hook, and can be automatically restored if there is a movement of the anode rod.

According to another aspect, the invention relates to a device for holding and for the connection of an anode rod in contact with an anode beam of an aluminium electrolytic cell, comprising:

two hooks fixed to the anode beam and between which the anode rod will be placed;

a connector comprising:

a) a body comprising at least one mobile part comprising a bearing face, the said mobile part being displaced such that the said bearing face applies a pressure on the anode rod, along a direction substantially perpendicular to the contact surface of the anode beam, b) a pair of protuberances each projecting laterally from the said body, globally oriented perpendicular to the said direction, each designed to rest on a hook, and c) an actuator capable of causing displacement of the said mobile part to bring it between a clamping position in which the said bearing face is in contact with the anode rod and forces it towards the anode beam when the said protuberances rest on the said hooks, and a release position in which the said bearing face does not apply any pressure on the anode rod. The hooks and/or the connector at least partially have a geometry and/or are at least partially formed from a material such that when the said protuberances are supported on the said hooks and the said actuator brings the mobile part into the clamping position, the said holding and connection device is elastically deformed sufficiently so that, if there is a change in the position of the anode rod with respect to the anode beam, the said connector remains in contact with the said anode rod due to its at least partial elastic return towards its unstressed position, and thus continues to hold the said anode rod firmly in contact with the said anode beam.

In particular, the device comprises a connector comprising a body including two levers with at least one bearing face, two substantially coaxial lateral rods each projecting laterally beyond a lever, each of which will rest on a hook, and a clamping screw that can pivot levers around the axis of the rods between a clamping position in which the bearing face of the levers is in contact with the anode rod and moves it towards the anode beam substantially perpendicular to it, and a release position in which the bearing face of the levers does not apply any pressure on the anode rod. The geometry of at least one hook, a lever and/or a lateral rod of the connector and the material from which they are formed are such that, when the screw for holding and connection of the anode rod is tightened, the elastic deformation of the holding device is sufficient so that the said holding device can compensate for a possible change in the position of the anode rod with respect to the anode beam, by at least partial elastic return towards its unstressed position, and thus continues to keep the said anode rod firmly in contact with the said anode beam.

Unlike in prior art, this device also avoids the need to use additional special parts (roller, spring, washer) that would have to be assembled to the other parts and regularly replaced.

The connector and/or the hook can be like the previously described connectors and hooks.

According to one possible embodiment, the width $L_C$ of the body of the connector is less than the width $L_{TA}$ of the anode rod, and for example $L_C < 0.8\ L_{TA}$.

Finally, according to another aspect, the invention relates to a method for holding and connection of an anode rod in contact with an anode beam of an aluminium electrolytic cell, comprising steps consisting of:

placing the anode rod between two hooks fixed to the anode beam:

providing a connector comprising:

a) a body comprising at least one mobile part comprising a bearing face, the said mobile part being displaced such that the said bearing face applies a pressure on the anode rod, along a direction substantially perpendicular to the contact surface of the anode beam, b) a pair of protuberances each projecting laterally from the said body, globally oriented perpendicular to the said direction, each designed to rest on a hook fixed to the anode beam on each side of the anode rod;

c) and an actuator capable of causing displacement of the said mobile part to bring it between a clamping position in which the said bearing face is in contact with the anode rod and forces it towards the anode beam when the said lateral protuberances rest on the said hooks, and a release position in which the said bearing face does not apply any pressure on the anode rod.

placing the connector on the hooks, by making each of the lateral protuberances rest on a hook, the connector being in a release position;

actuating the actuator to bring the mobile part into a clamping position.

In this method according to this aspect of the invention, the actuator is actuated to cause a sufficient elastic deformation of at least one hook and/or at least one part or the connector so that, due to the at least partial elastic return of the said hook and/or at least one part or the connector towards its unstressed position, the said connector remains in contact with the said anode rod and thus continues to hold the said anode rod firmly in contact with the said anode beam.

In particular, this aspect of the invention relates to a method of holding and connecting an anode rod in contact with an anode beam of an aluminium electrolytic cell, comprising steps consisting of:

placing the anode rod between two hooks fixed to the anode beam;

providing a connector comprising a body comprising two levers with at least one bearing face, two substantially coaxial lateral rods each projecting laterally from a lever and a clamping screw;

placing the connector on the hooks, making each of the lateral rods rest on a hook, the connector being in a release position in which the bearing face of the levers does not apply any pressure on the anode rod;

activating the clamping screw to cause pivoting of the levers around the axis of the rods towards a clamping position in which the bearing face of the levers is in contact with the anode rod and moves it towards the anode beam substantially perpendicular to the anode beam.

The clamping screw is actuated to cause a sufficient elastic deformation of at least one hook, one lever and/or one lateral rod of the connector with respect to the anode beam so that the said hook, the said lever and/or the said lateral rod can compensate for a possible change in the position of the anode rod with respect to the anode beam, by at least partial elastic return towards its unstressed position, and thus continue to keep the said anode rod firmly in contact with the said anode beam, the geometry of the said lever and/or the said lateral rod, and the material from which they are made, being chosen to enable such an elastic deformation and such an elastic return.

The connector and/or the hook may be like the connectors and hooks described above.

BRIEF DESCRIPTION OF THE DRAWINGS

To facilitate understanding, the invention is described once again below with reference to the appended figures that represent several possible embodiments of the invention.

DESCRIPTION OF THE PREFERRED EMBODIMENTS

Figure 1:
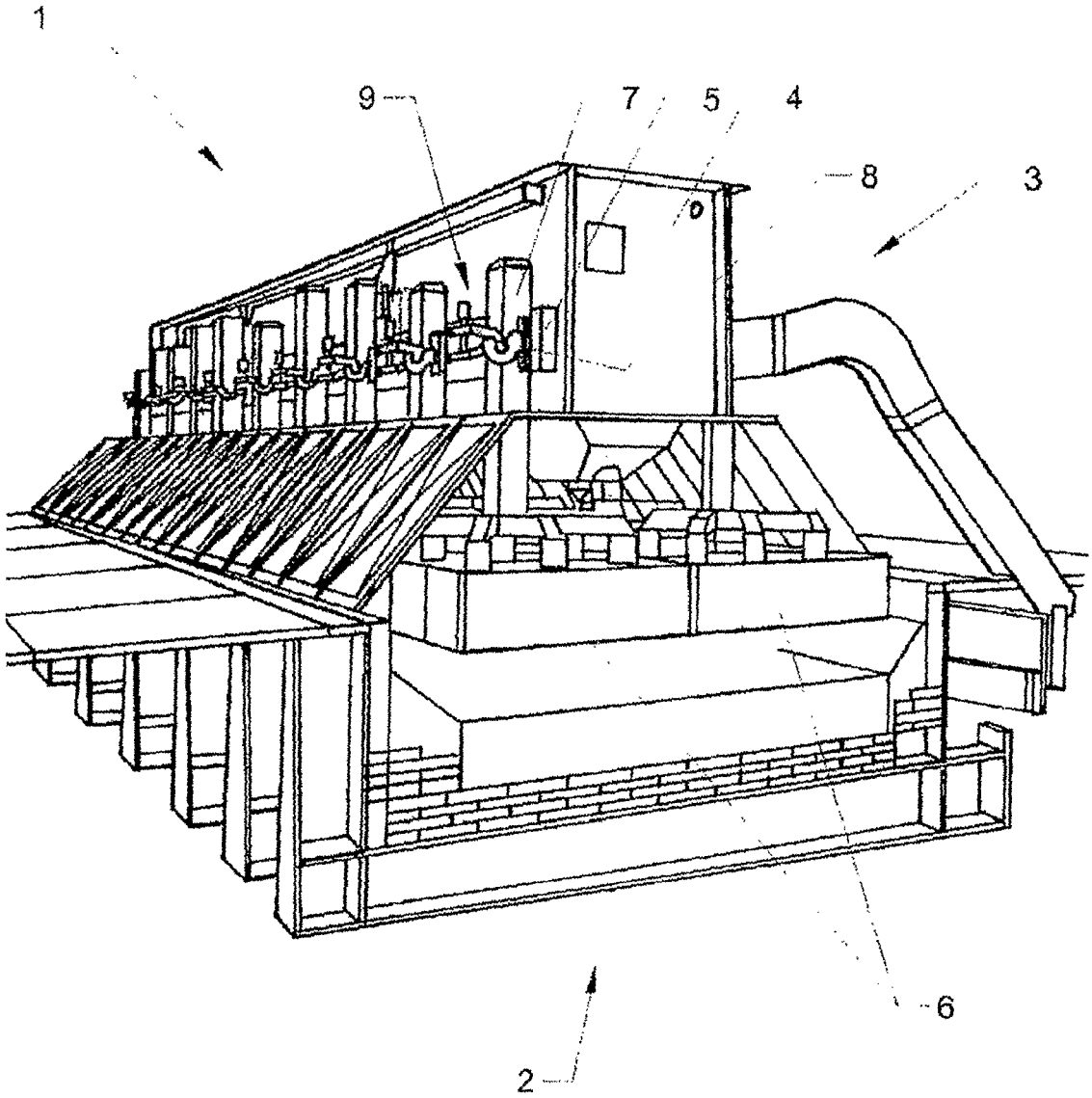
FIG. 1 shows a perspective view of a typical electrolytic cell intended for the production of aluminium.
Figure 2:
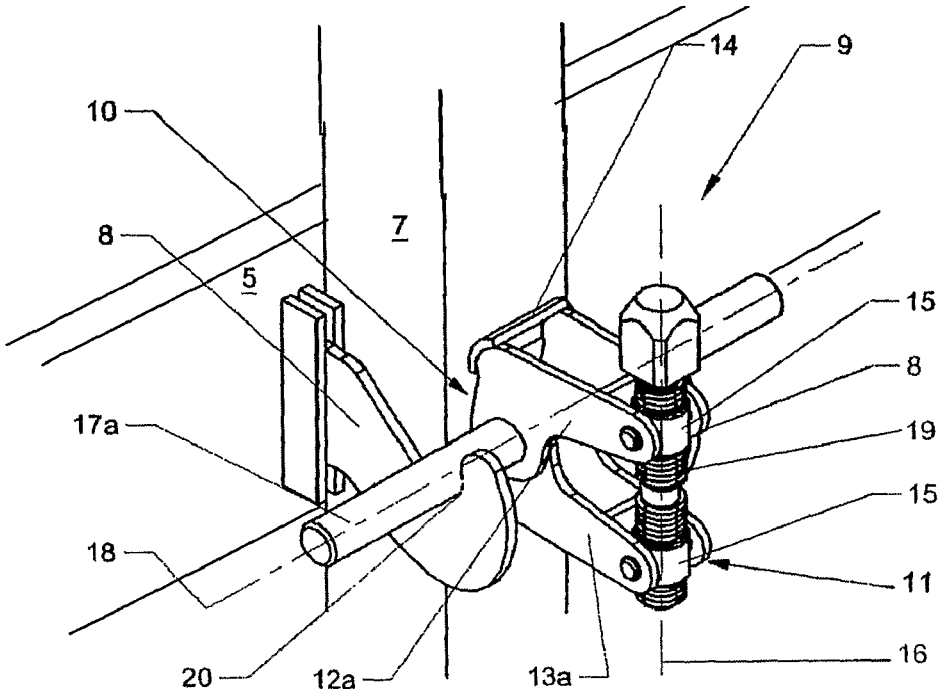
FIG. 2 is a perspective view of an anode rod held in contact with an anode beam by a holding and connection device according to a first embodiment of the invention.

As illustrated in FIG. 1, an electrolytic cell 1 comprises a pot 2 that can contain liquid metal and electrolyte bath, and a superstructure 3 comprising a fixed portal frame 4 and a mobile metallic anode beam 5.

The electrolytic cell 1 also comprises anodes 6 provided with a metallic rod 7 that can be used for the attachment and electrical connection of the anodes 6 to the anode beam 5. Each anode rod 7 is connected to the anode beam 5 by a holding and connection device. This device comprises two hooks 7 fixed to the anode beam 5, substantially at the same height, and between which the anode rod 7 will be positioned, with a connector 9.

The connector 9 firstly comprises a body including two levers, namely an upper lever 10 and a lower lever 11, each of which has two side plates 12*a*, 12*b*, 13*a*, 13*b*. The side plates are almost identical. The two side plates for the same lever are connected firstly at their front part by a pad 14, at least part of which forms the bearing face of the levers 10, 11 and that will apply pressure on the anode rod 7 towards the anode beam 5, and secondly at their back part by a nut 15, the two nuts 15 being substantially along the same axis 16. The lower lever 11 in the front part of the body is typically placed partially between the two side plates 12*a*, 12*b* of the upper lever 10.

The connector 9 also comprises two lateral rods 17*a*, 17*b*, substantially cylindrical and with the same axis 18, one projecting beyond one side and the other projecting beyond the other side of the connector 9, in the front area of the body. According to one possible embodiment, the two lateral rods 17*a*, 17*b* are composed of a single rod passing through the body of the connector 8 and projecting laterally on each side of the said body. The lateral rods 17*a* and 17*b* will each rest on a hook 8.

Figure 3:
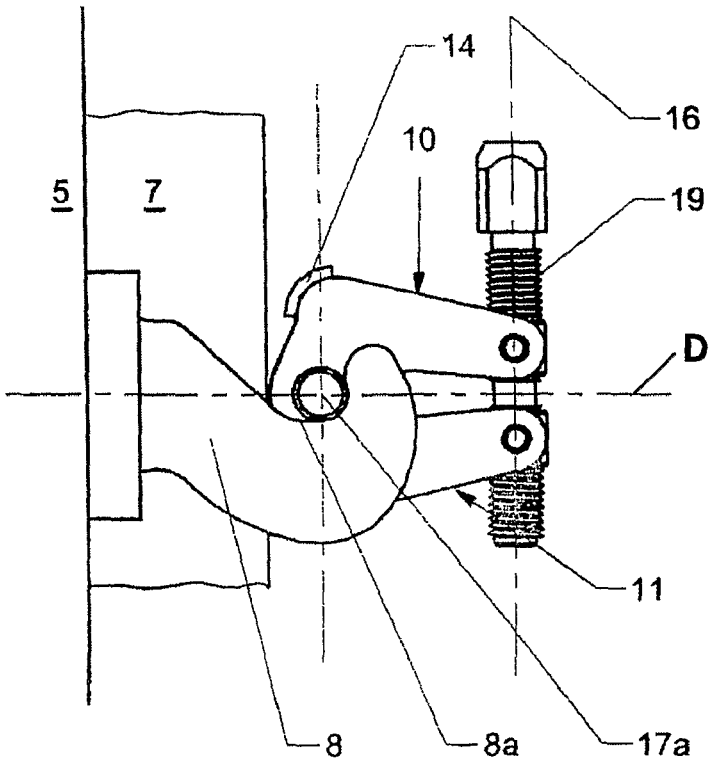
FIGS. 3 and 4 show lateral views of the anode rod and the device in FIG. 2 respectively, in the release position and in the clamping position.

Finally, the connector 9 comprises a clamping screw 19 engaged in the nuts 15 and with two threaded areas with opposite threads each cooperating with a nut 15. Thus, rotating the screw 19 around the axis 16 using an appropriate clamping device cooperating with the screw head, causes the levers 10, 11 to pivot about the axis 18 of the lateral rods 17*a*, 17*b*, between a clamping position in which the two nuts 15 are at a distance from each other (FIG. 4) and a release position in which the two nuts 15 are substantially in contact (FIG. 3).

Figure 4:
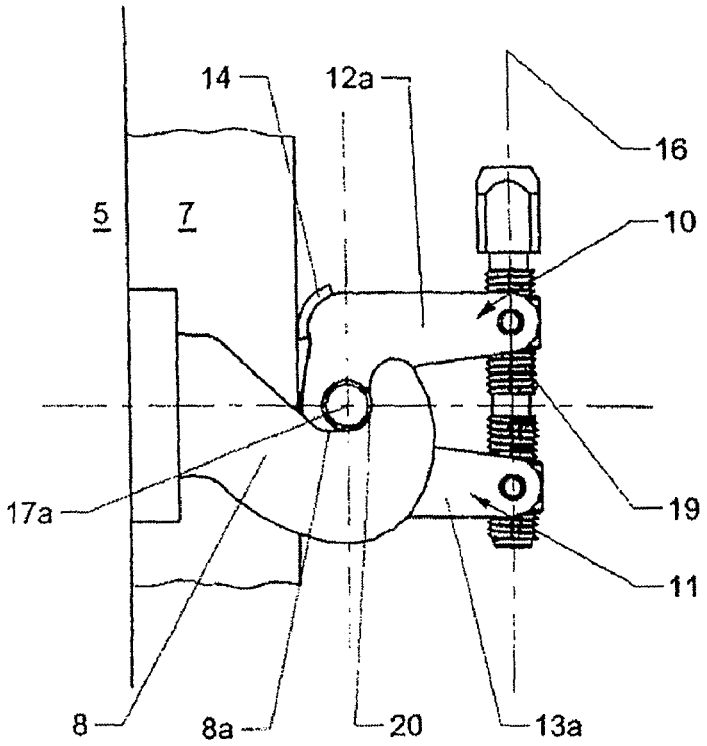

The anode rod 7 is connected to the anode beam 5 by placing the anode rod 7 between the two hooks 8 already fixed to the anode beam 5, then placing the connector 9 on the hooks 8 making each of the lateral rods 17*a*, 17*b* rest in the hollow part 8*a* of a hook 8, the connector 8 being in the release position. In this position, the bearing face of the levers 10, 11 applies little or no pressure on the anode rod 7 (FIG. 3). The clamping screw 19 is than actuated to make the levers 10, 11 pivot towards the clamping position. In the clamping position, the bearing face of the levers 10, 11 is in contact with the anode rod 7 and moves it towards the anode beam 5 substantially perpendicular to the anode beam, thus holding and connecting the anode rod 7 to the anode beam 5 (FIG. 4).

The holding and connection device is designed to give excellent clamping of the anode rod 7 in contact with the anode beam 5 at all times, even if the anode rod 7 moves with respect to the anode beam 5. This is achieved by manipulating the clamping screw 19 during assembly to cause an elastic deformation of at least one element of the device (hook, lever, lateral rod) with respect to the anode beam 5. Thus, this or these elements can compensate for a possible change in the position of the anode rod 7 with respect to the anode beam 5 by at least partial elastic return towards its unstressed position, and the device can thus continue to hold the anode rod 7 in contact with the anode beam 5.

According to a first embodiment illustrated in FIGS. 2 to 5, this elastic effect is achieved by the lateral rods 17*a*, 17*b* of the connector 9.

In this embodiment, the width $L_C$ of the body of the connector 9 is relatively narrow compared with the width $L_{TA}$ of the anode rod 7. Consequently, since the hooks 8 are located close to and on each side of the anode rod 7, the distance L between the body of the connector 9 and the bearing area 20 of a lateral rod 17*a*, 17*b* on the corresponding hook 8 is relatively large. Due to this large cantilever, the lateral rods 17*a*, 17*b* can deform as shown diagrammatically on FIG. 5 when the screw 19 is tightened, with the axis 18 of the lateral rods 17*a*, 17*b* becoming curved and moving the body of the connector 9 away from the anode beam. The diameter D of the lateral rods 17*a*, 17*b* and the yield stress of the material from which they are made are chosen so as to enable a sufficient deformation of the lateral rods 17*a*, 17*b*, in other words storage of sufficient mechanical energy in the lateral rods 17*a*, 17*b* that can be restored if the position of the anode rod 7 is changed. In this case, the lateral rods 17*a*, 17*b* will at least partially return towards their unstressed position, and there is still a clamping force clamping the anode rod 7 in contact with the anode beam 5.

According to one possible embodiment:

- the diameter D of the lateral rods 17*a*, 17*b* is between 45 and 65 mm, for example 57 mm;
- the material from which the lateral rods 17*a*, 17*b* are made is a steel with a yield stress of the order of 1040 $N/mm^2$;
- the width $L_C$ of the body of the connector 9 is between 90 and 120 mm;
- the distance L is between 95 and 115 mm for an anode rod with width $L_{TA}$=140 mm and between 130 and 165 mm for an anode rod with width $L_{TA}$=220 mm.

The same connector 9 is used for all anode rods for which the width $L_{TA}$ is between 140 and 220 mm, which covers 90% of all applications. Thus, since the width $L_C$ of the body of the connector 9 is constant, the cantilever (distance L) and therefore the reserve of mechanical energy, increase as the width $L_{TA}$ of the anode rod 7 increases.

With these values, and for a force of 16 tonnes (8 tonnes on each hook 8), the displacement d of the body of the connector 9 can be at least 0.8 mm for an anode rod 7 with width 140 mm, and at least 1.8 mm, or even more than 3 mm, for an anode rod 7 with width 220 mm, these values corresponding to 300% and 400% respectively of values possible with prior art, for the same diameter of the lateral rods 17*a*, 17*b*.

Figure 5:
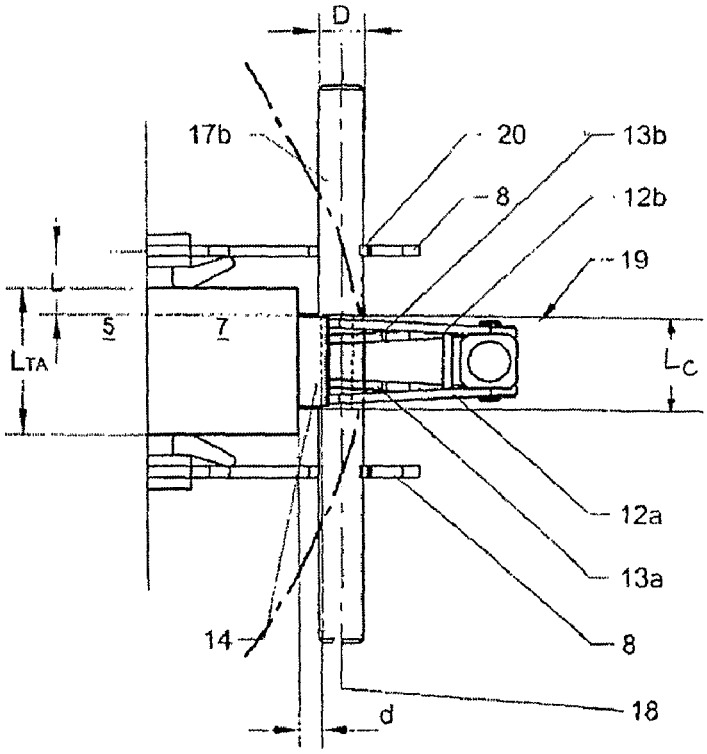
FIG. 5 shows a top view of the anode rod and the device in FIG. 2, diagrammatically showing the axis of the lateral rods in dashed lines, and partially showing the body of the connector in the deformed position.

The connector 9 shown in FIG. 5 is symmetrical, but other structures could be envisaged in which one of the two lateral rods 17*a*, 17*b* is longer and/or more deformable than the other.

According to one possible embodiment, the pad 14 formed on the levers 10, 11 is made from an elastically deformable material. Under the clamping effect of the screw 19, the pad 14 is therefore compressed between the corresponding lever 10, 11 and the anode rod 7, and if necessary can return at least partially to its unstressed position and continue to apply the mechanical force to the anode rod 7 necessary to connect and hold the anode rod correctly in contact with the anode beam 5.

Figure 6:
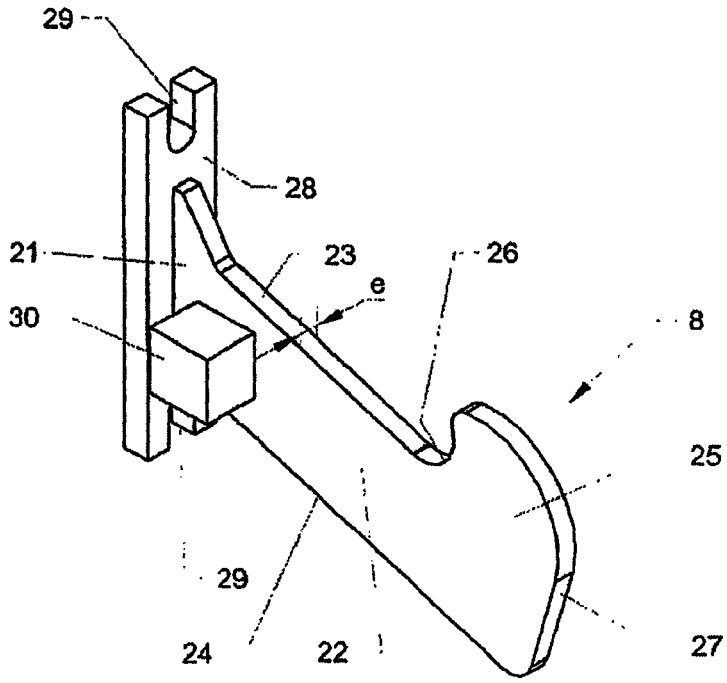
FIGS. 6 and 7 show perspective and lateral views of a hook according to another embodiment of the invention.
Figure 7:
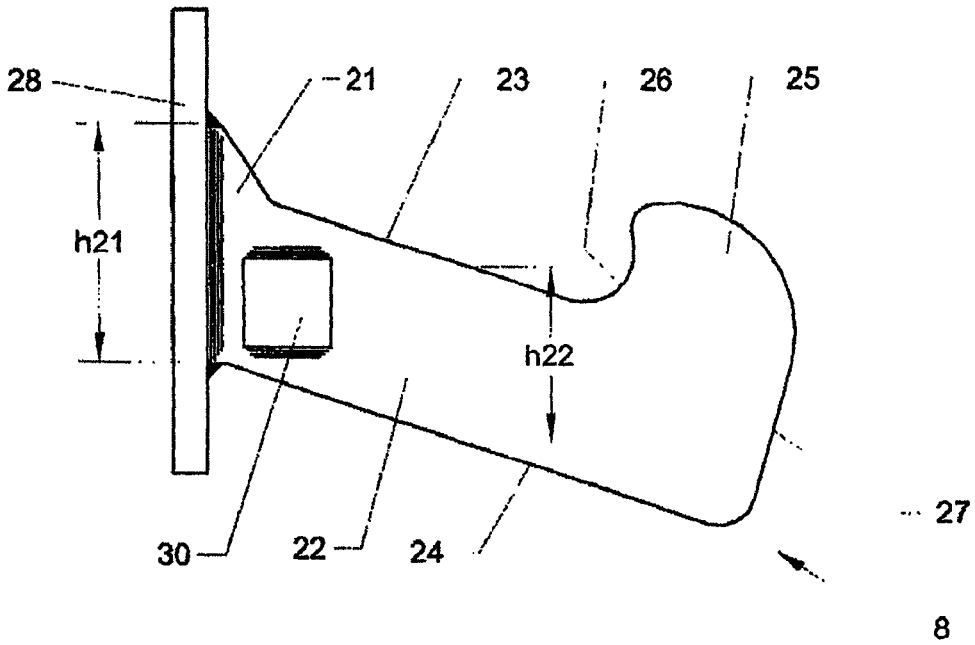

According to another embodiment illustrated on FIGS. 6 and 7, the elastic effect is achieved by the hooks 8.

The hook 8 comprises an attachment base 21 prolonged by a supporting body 22 for which the upper edges 23 and the lower edges 24 are substantially parallel, and a curved end part 25 defining a hollow 26 in which a lateral rod 17*a*, 17*b* fits and for which the free end 27 is substantially perpendicular to the lower edge 24 of the support body 22.

The bottom of the hook 8 is welded to a base 28 provided with two recesses 29 that make the attachment onto the anode beam 5 by screwing. Positioning means 30 are also formed on a side face of the hook 8 designed to face the anode rod 7, for guidance and positioning of the anode rod 7 between the hooks 8.

The height h22 of the support body 22 is substantially constant and is between 60 and 85% of the height h21 of the base 21. For example, h21 is of the order of 135 mm and h22 is of the order of 100 mm.

According to one possible embodiment, the hook 8 is made of steel and is less than 18 mm thick, for example 15 mm. The hook 8 may also comprise local areas for which the thickness is less than the general thickness e of the hook 8.

Figure 8:
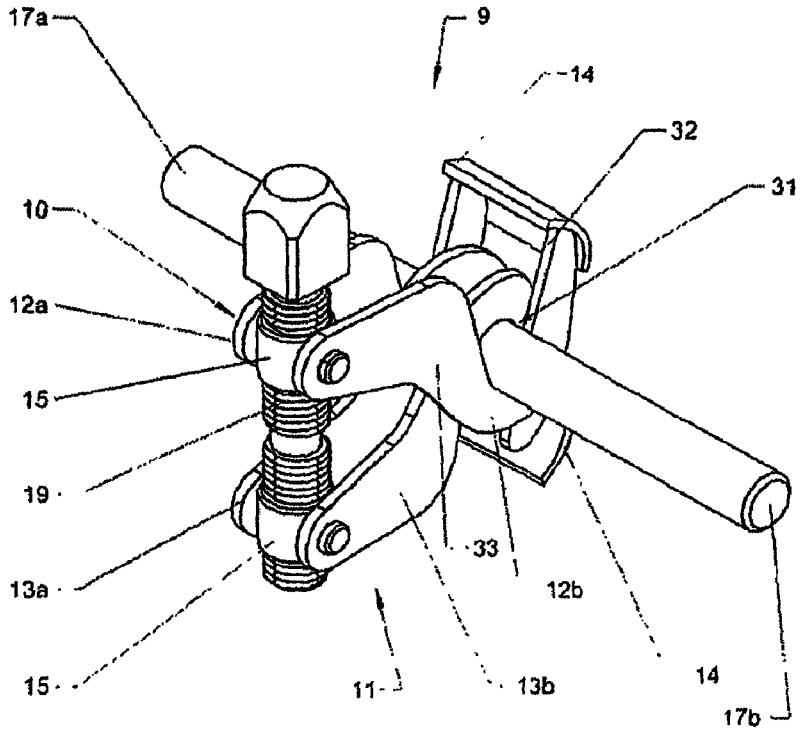
FIG. 8 shows a perspective view of a connector according to yet another embodiment of the invention.

The hook 8 thus has a greater capacity for elastic deformation than hooks according to prior art. Thus, for a force of 16 tonnes (8 tonnes on each hook), the displacement from the bottom 26 of the hook 8 along the direction of the force that is substantially horizontal, is at least 20% greater than the displacement obtained with known hooks. If the anode rod 7 changes position, the hook 8 can at least partially restore the mechanical energy stored in it by deforming elastically, and continue to hold the anode rod 7 correctly in contact with the anode beam 5. According to another embodiment illustrated in FIG. 8, the levers 10, 11 provide the elastic effect.

The two side plates 12*a*, 12*b* of the upper lever 10 are substantially identical and each is provided with a recess 31 formed in the forwards direction from their upper edge. The two side plates 13*a*, 13*b* of the lower lever 11 are practically the same. Each is provided with a recess 31 formed in the forwards direction from their lower edge, and are placed between the side plates 12*a*, 12*b* of the upper lever 10 such that the recesses 31 are substantially facing each other and define a housing in which the substantially horizontal lateral rods 17*a*, 17*b* (or a single through rod) can fit. The four plates are substantially in the shape of question marks placed in pairs in inverted positions. As a variant, only the side plates 12*a*, 12*b* of the upper lever 10 or only the side plates 13*a*, 13*b* of the lower lever 11 have such a recess, the elastic effect then resulting from the lever for which the plates comprise the recess. In one embodiment of this variant illustrated in FIG. 8, the lateral rods 17*a*, 17*b* are arranged in the bottom of the recesses 31. In another embodiment of this variant, the lateral rods 17*a*, 17*b* pass through the side plates 12*a*, 12*b*, typically close to the bottom of the recesses 31; in this case, the recesses 31 are shallower than they are in the previous embodiment.

Due to the recess 31, each side plate 12*a*, 12*b*, 13*a*, 13*b* comprises two branches 32, 33 separated from each other along a direction perpendicular to the anode beam 5. The side plates are capable of elastic deformation perpendicular to the anode beam 5, by bringing the two branches 32, 33 towards the same recess 31.

Figure 9:
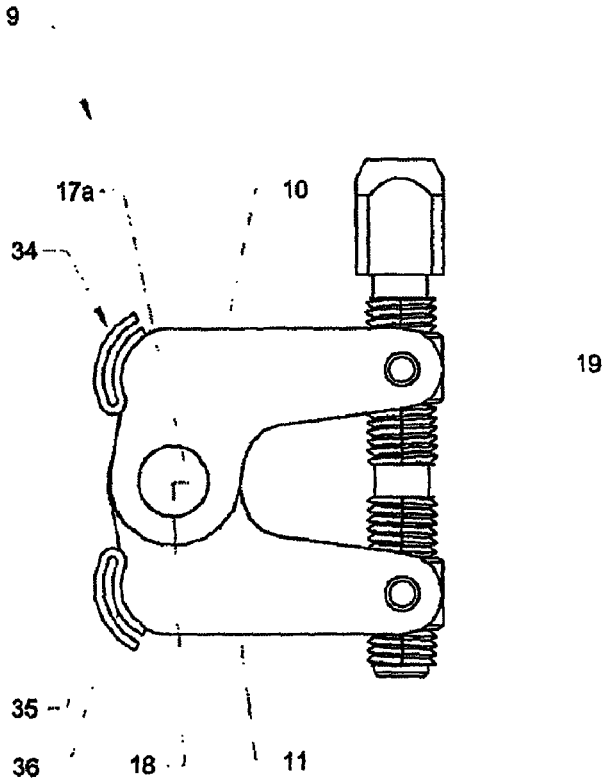
FIG. 9 shows a lateral view of a connector according to yet another embodiment of the invention.

Finally, according to another embodiment illustrated on FIG. 9, the pads on FIGS. 2 to 5 are in the form of elastic tabs folded on themselves.

In the unstressed state, the two branches 35, 36 of a tab 34 are at a spacing from each other. When the connector 9 is clamped in contact with the anode rod 7, the two branches 35, 36 move towards each other by elastic deformation until they become adjacent. If the anode rod 7 changes position, the two branches 35, 36 will return to their unstressed position and due to the elastic effect, they will continue to bring the anode rod 7 towards the anode beam 5.

Obviously, two or more of the embodiments described above could be combined to obtain a capacity for elastic deformation, and therefore even larger compensation for the movements of the anode rod.

Obviously, the invention is not limited to the embodiments described above as examples, but on the other hand it encompasses all variant embodiments.

The invention claimed is:

1. Connector for holding and connecting an anode rod in contact with an anode beam of an aluminum electrolytic cell, comprising:

a body comprising at least one mobile part comprising a bearing face, the mobile part being arranged for movement such that the bearing face applies pressure on the anode rod along a direction substantially perpendicular to the contact surface of the anode beam;

a pair of substantially axial lateral protuberances each projecting beyond the sides of the body, oriented substantially perpendicular to the direction, each protuberance being designed to rest on a hook fixed to the anode beam, on each side of the anode rod; and an actuator that is constructed and arranged to displace the mobile part to bring the mobile part between a clamping position in which the bearing face is in contact with the anode rod and forces the mobile part towards the anode beam when the lateral protuberances rest on the hooks, and a release position in which the bearing face does not apply any pressure on the anode rod;

wherein said connector at least partially has a geometry and/or is at least partially composed of a material such that, when the actuator brings the mobile part into the clamping position, the connector is elastically deformed sufficiently so that, if there is a change in the position of the anode rod with respect to the anode beam, the connector remains in contact with the anode rod due to at least partial elastic return towards an unstressed position, and thus continues to hold the anode rod firmly in contact with the anode beam.

2. Connector according to claim 1, comprising at least one part capable of storing sufficient elastic deformation energy to cause a displacement greater than 0.6 mm of the bearing face towards the anode beam, when the clamping force is released.

3. Connector according to claim 1, comprising at least one part capable of storing sufficient elastic deformation energy to compensate for angular displacement of the anode rod with the vertical of at least 0.15.

4. Connector according to claim 1, wherein the connector comprises a material with a yield stress greater than 1000 $N/mm^2$.

5. Connector according to claim 1, comprising:

a body comprising two levers intended for applying a pressure on the anode rod towards the anode beam through at least one bearing face;

two substantially coaxial lateral rods, each projecting laterally from the body and each being designed to rest on a hook fixed to the anode beam, on each side of the anode rod; and a clamping screw capable of causing the levers to pivot around the axis of the lateral rods between a clamping position in which the bearing face of the levers is in contact with the anode rod and moves the anode rod towards the anode beam substantially perpendicular to the anode beam, and a release position in which the bearing face of the levers does not apply pressure on the anode rod;

wherein the geometry of at least one lever and/or lateral rod of the connector and the material from which it is made are capable of enabling sufficient elastic deformation of the connector when the screw is tightened to hold and connect the anode rod, such that if the position of the anode rod with respect to the anode beam is changed, the connector remains in contact with the anode rod due to at least partial elastic return towards an unstressed position, and thus continues to hold the anode rod firmly in contact with the anode beam.

6. Connector according to claim 5, wherein at least one said lateral rod is made from a material having a yield stress of more than 1000 $N/m^2$, and the body of the connector and the bearing area of the rod designed to rest on the hook fixed to the anode beam are separated by a sufficiently large distance to enable elastic deformation of the rod and consequently a displacement of the body of the connector substantially perpendicular to the anode beam, with an amplitude greater than 0.6 mm.

7. Connector according to claim 6, wherein at least one said lateral rod is made of steel.

8. Connector according to either claim 6, wherein the distance between the body of the connector and the bearing zone of the corresponding lateral rod is between 20% and 40% of the distance between bearing zones of the two lateral rods.

9. Connector according to claim 5, wherein at least one said lever comprises at least one side plate with a recess formed from an upper edge or a lower edge thereof, and defining two branches separated from each other in a direction perpendicular to the lateral rods.

10. Connector according to claim 9, wherein a bottom of the recess forms a housing in which a lateral rod will fit.

11. Connector according to claim 5, wherein the upper lever comprises two substantially identical side plates and each is provided with a recess formed from an upper edge, and wherein the two side plates of a lower lever are substantially the same, each is provided with a recess formed from a lower edge, the lower lever being placed between the side plates of an upper lever such that the recesses are substantially facing each other and define a housing in which the substantially horizontal lateral rods can fit.

12. Connector according to claim 5, wherein at least one said lever comprises an elastic pad, at least part of which forms the bearing face of the lever on the anode rod.

13. Connector according to claim 12, wherein the pad is in the form of an elastic tab folded on itself.

14. Connector according to claim 13, wherein the elastic tab is made from steel.

15. Hook designed to be fixed to an anode beam of an aluminum electrolytic cell to hold and connect an anode rod placed on a side of the hook in contact with the anode beam, and on which a connector is arranged to rest that can be actuated between a clamping position in which the connector is in contact with the anode rod and pulls the anode rod towards the anode beam substantially perpendicular to the anode beam, and a release position in which the connector does not apply any pressure on the anode rod, wherein the geometry of the hook and the material from which the hook is made are such that, when the connector is moved towards the clamping position, there is an elastic deformation of the hook with respect to the anode beam sufficient that the hook compensates for a possible change in the position of the anode rod with respect to the anode beam, and thus continues to hold the anode rod firmly in contact with the anode beam.

16. Hook according to claim 15, comprising an attachment base, a supporting body for which upper edges and lower edges are substantially parallel, and a curved end part.

17. Hook according to claim 16, wherein the supporting body has a substantially constant height and is between 60 and 85% of a height of the base.

18. Hook according to claim 15, wherein the supporting body is made of steel and has a thickness less than 18 mm.

19. Hook according to claim 15, comprising local areas for which thickness is less than a general thickness of the hook.

20. Device for holding and connection of an anode rod in contact with an anode beam of an aluminum electrolytic cell, comprising:

two hooks fixed to the anode beam and between which the anode rod is constructed and arranged to be placed;

a connector comprising:

a) a body comprising at least one mobile part comprising a bearing face, the mobile part being displaced such that the bearing face applies a pressure on the anode rod along a direction substantially perpendicular to the contact surface of the anode beam, b) a pair of protuberances, each projecting laterally from the body, globally oriented perpendicular to the direction, each designed to rest on a said hook, and c) an actuator constructed and arranged for causing displacement of the mobile part to bring the mobile part between a clamping position in which the bearing face is in contact with the anode rod and forces the bearing face towards the anode beam with the protuberances resting on the hooks, and a release position in which the bearing face does not apply any pressure on the anode rod, wherein the hooks and/or the connector at least partially have a geometry and/or are at least partially formed from a material such that when the protuberances are supported on the hooks and the actuator brings the mobile part into the clamping position, the holding and connection device is elastically deformed sufficiently such that, if there is a change in the position of the anode rod relative to the anode beam, the connector remains in contact with the anode rod due to at least a partial elastic return towards an unstressed position, and thus continues to hold the anode rod firmly in contact with the anode beam.

21. Holding and connection device according to claim 20, wherein the connector comprises a body with two levers with at least one bearing face, two substantially coaxial lateral rods, each being provided with a lever on a side thereof, each intended to rest on a hook, and a clamping screw that is arranged to pivot the levers about the axis of the rods between a clamping position in which the bearing face of the levers is in contact with the anode rod and moves the anode rod towards the anode beam substantially perpendicular to the anode beam, and a release position in which the bearing face of the levers does not apply any pressure on the anode rod;

wherein the geometry of at least one hook, a lever and/or a lateral rod of the connector and the material of formation are such that, when the screw for holding and connection of the anode rod is tightened, elastic deformation of the holding device with respect to the anode beam is sufficient so that the holding device compensates for a possible change in the position of the anode rod with respect to the anode beam, by at least partial elastic return towards an unstressed position, and thus continues to keep the anode rod firmly in contact with the anode beam.

22. Device according to either claim 21, wherein the body of the connector has a width $L_c$, less than a width $L_{TA}$ of the anode rod.

23. Device according to claim 22, wherein $L_c<0.8L_{TA}$ .

24. Method for holding and connection of an anode rod in contact with an anode beam of an aluminum electrolytic cell, comprising the steps of:

placing the anode rod between two hooks fixed to the anode beam;

providing a connector comprising:

a) a body comprising at least one mobile part comprising a bearing face, the mobile part being displaced such that the bearing face applies a pressure on the anode rod along a direction substantially perpendicular to the contact surface of the anode beam, b) a pair of protuberances each projecting laterally from the body, globally oriented perpendicular to the direction, each designed to rest on a hook fixed to the anode beam on each side of the anode rod; and c) an actuator capable of causing displacement of the mobile part to bring the mobile part between a clamping position in which the bearing face is in contact with the anode rod and forces the bearing face towards the anode beam when the lateral protuberances rest on the hooks, and a release position in which the bearing face does not apply any pressure on the anode rod;

placing the connector on the hooks, by making each of the lateral protuberances rest on a hook, the connector being in a release position; and actuating the actuator to bring the mobile part into a clamping position;

wherein the actuator is actuated to cause a sufficient elastic deformation of at least one hook and/or at least one part or the connector so that, due to the at least partial elastic return of the hook and/or the part of the connector towards an unstressed position, the connector remains in contact with the anode rod and thus continues to hold the anode rod firmly in contact with the anode beam.

25. Method according to claim 24, comprising the steps of:

placing the anode rod between two hooks fixed to the anode beam;

providing a connector comprising a body comprising two levers with at least one bearing face, and two substantially coaxial lateral rods each projecting laterally from a lever and a clamping screw;

placing the connector on the hooks, causing each of the lateral rods to rest on a said hook, the connector being in a release position in which the bearing face of the levers does not apply any pressure on the anode rod; and actuating the clamping screw to cause pivoting of the levers around the axis of the rods towards a clamping position in which the bearing face of the levers is in contact with the anode rod and moves the anode rod towards the anode beam substantially perpendicular to the anode beam;

wherein the clamping screw is actuated to cause a sufficient elastic deformation of at least one hook, one lever and/or one lateral rod of the connector with respect to the anode beam so that the hook, the lever and/or the lateral rod can compensate for a possible change in the position of the anode rod with respect to the anode beam, by at least partial elastic return towards an unstressed position, and thus continue to keep the anode rod firmly in contact with the anode beam, the geometry of the hook, the lever and/or the lateral rod, and the material of formation being chosen to enable such an elastic deformation and such an elastic return.

* * * * *